United States Patent [19]

Stanley et al.

[11] Patent Number: 4,561,122

[45] Date of Patent: Dec. 31, 1985

[54] PROTECTIVE GLOVE FOR MAXIMIZED TACTILEGNOSIS

[75] Inventors: Carol A. J. Stanley, Collingswood, N.J.; Kim C. Miller, Binghamton, N.Y.

[73] Assignee: Stash, Inc., Collingswood, N.J.

[21] Appl. No.: 568,133

[22] Filed: Jan. 4, 1984

Related U.S. Application Data

[63] Continuation-in-part of Ser. No. 387,661, Jun. 11, 1982, abandoned.

[51] Int. Cl.[4] ..... A41D 13/10

[52] U.S. Cl. ..... 2/20; 2/19; 2/161 A; 2/167

[58] Field of Search ..... 2/16, 19, 20, 161 R, 2/161 A, 159, 167

[56] References Cited

U.S. PATENT DOCUMENTS

| | | | |
|---|---|---|---|
| 325,968 | 9/1885 | Rawlings | 2/19 |
| 360,135 | 3/1887 | Bloomstrom | 2/19 |
| 709,595 | 9/1902 | Carson | 2/161 R |
| 1,471,801 | 10/1923 | Neal | 2/161 R |
| 2,309,516 | 1/1943 | Lindfelt | 2/159 |
| 2,344,477 | 3/1944 | Wells, Jr. | 2/159 |
| 2,907,046 | 11/1959 | Scherr | 2/159 |
| 3,952,333 | 4/1976 | Fujita | 2/161 A |
| 4,256,096 | 3/1981 | Budde | 128/70 |

FOREIGN PATENT DOCUMENTS

| | | | |
|---|---|---|---|
| 1039431 | 10/1953 | France | 2/161 R |
| 483207 | 2/1970 | Switzerland | 2/161 R |

*Primary Examiner*—Werner H. Schroeder
*Assistant Examiner*—T. Graveline
*Attorney, Agent, or Firm*—Eugene E. Renz, Jr.

[57] ABSTRACT

A protective glove 10 constructed of shock-absorbent material, comprising digital sheaths 16, 18, 20, 22 and 24 anchored to a metacarpal sheath 14. The sheaths 16, 18, 20, 22 and 24 extend to cover the second-innermost joint of each digit, 17, 19, 21, 23 and 25. As a result, the glove 10 pads the critical area of wrap-around grasp—the metacarpals and the entire shaft of the proximal phalanx—yet permits unimpeded fingertip feel by exposing the distal phalanges. The glove 10 further preserves normal hand sensations during flexion and extension: by covering both the palmar curve and the dorsal surfaces of the second-innermost joints, the glove 10 exerts forces on the palmar surface and the aforesaid joints in proportion to the forces caused by normal compression and stretching at those respective positions on an unprotected hand. As a result, the device not only permits wrap-around grasp and allows fingertip feel, but preserves the normal palmar/dorsal balance of sensation, all of which maximize the "cognizance-by-touch" abilities of a gloved human hand.

3 Claims, 6 Drawing Figures

PROTECTIVE GLOVE FOR MAXIMIZED TACTILEGNOSIS

This is a continuation-in-part of application Ser. No. 387,661 filed June 11, 1982 now abandoned.

INTRODUCTION

The skin and structures of the human hand enable "tactilegnosis", the unique phenomenon of cognizance-by-touch in which the hand can "see" what it is doing without the aid of the eye. Because hand skin has special elasticity, and because palmar ("inner") hand skin has more tactile corpuscles and nerve connections per unit area than does the skin on any other part of the body, the hand is the end organ with the highest degree of discriminating sensation.

Unfortunately, the hand is also uniquely susceptible of injury to its miniature bones and delicate tissues. Protective coverings, in the form of pads or gloves, are often required to protect the hand from occupational or recreational traumas. In particular,those who play baseball or softball have a special need for protection against painful and debilitating bone contusions: each player must endure not only the repeated impact of a high-speed ball but the additional shock inflicted upon the pressure points of the hands while "at bat."

The present invention was developed to permit equivalent protection of the hand (during baseball or other activities) as that accomplished by existing protective arrangements, but which would also maximize wearer tactilegnosis, longevity of protection, ease of positioning and removal, effectiveness and ease of grip, and overall hand comfort.

BACKGROUND OF THE INVENTION

As illustrated by the prior art arrangements, the hand is most often protected against trauma and contusion by a padded device; those who use percussive hand tools (such as a hammer or axe) or who participate in sports (such golf, the racquet sports or baseball in particular) are commonly appreciative of the protection afforded by such shields. Indeed, a single contusion to a hand bone of a baseball player will often create an area of tiny stress fractures which reamin painful or hypersensitive throughout an entire season, thus inhibiting performance ability and quality. Baseball and softball players, therefore, require a glove which maximizes protection against tissue damage and bone contusion.

One such protective device (set forth in U.S. Pat. No. 4,071,913 to Rector) covers the entire hand, including the fingers and wrist, with a leather glove. Additional padding is provided at the fingertips, the palmar surface of the thumb, and the palmar skin from the wrist to the base of the fingers. (Other devices which cover the entire hand include U.S. Pat. Nos. 4,121,824; 4,042,975; 1,797,116 and 3,267,486 to Hirschfield, Elliott, Barden and Madnick, respectively.) Tactilegnosis partially depends, however, on the palmer surface (i.e., the skin on the inner side of the hand), and on the particular sensitivity of the palmar fingertip skin which is roughly 20 to 30 times as sensitive as skin anywhere else on the body. Because these full protective gloves cover the entire palmer surface, the devices eliminate a significant portion of the "fingertip feel" tactilegnotic ability of the hand.

Another protective device covers, by means of a flexible padded tube with a thumbhole, the palmar and dorsal areas from the wrist to the roots of the finger (U.S. Pat. No. 4,176,407 to Goebel). This device is similar to the fingerless glove which leaves each digit completely exposed (U.S. Pat. No. 425,887 to Kohler). A third device covers a portion of each proximal phalanx ("finger" bone) in addition to covering the metacarpal area of the hand. (U.S. Pat. Nos. 325,968; 3,606,614; 3,501,773; 4,183,100 and 2,465,136 to Rawlings, Dimitroff, Stansberry et al, DeMarco and Troccoli, respectively, illustrate examples of this third device.) All of these devices cushion the metacarpophalangeal joints ("knuckles") and both sides of the metacarpal region, but unduly impede tactilegnosis and the ease and effectiveness of grip. Even though the fingertips are left uncovered, the devices interfere with two additional sensations requisite to tactilegnosis: "dorsal resistance" and "wrap-around grasp," described below.

As a "flat" hand contracts, the dorsal skin stretches and extends approximately one and one-half inches, and the associated tissues extend accordingly. The increasing tightness of the skin results in an awareness of increasing skin resistance as the hand tightens into a fist or grasps an object or surface. Ordinarily, this "dorsal resistance" is most noticeable at the dorsal surface of the proximal interphalangeal joints (the innermost joints of the fingers) due to the extreme angular rotation which occurs between the proximal and middle phalanges during hand contraction. Another sensation, that of "palmar compression," results from compression of the palmar tissues during flexion and occurs simultaneously with dorsal resistance. As does the sensation of dorsal resistance, the sensation of palmar compression increases proportionately to the degree of contraction in the hand. In the normal operation of the hand, such as quick catching and throwing during baseball, therefore, dorsal resistance remains proportional to palmar compression. This dual and balanced sensory awareness is crucial in the precise execution of the sensitive hand movement required during sports and other activities.

The second sensation, experienced during flexion, relates to the configurational folding of the palmar tissues as the hand contracts. As the sensitive palmar skin folds (i.e., as the hands contract about a baseball bat) the skin assumes a padded and curved formation. Continuity of this curve is of particular importance between the metacarpals ("palm" bones) and the middle phalanx ("finger" bone) of each digit; it is in this area that the hand curves almost 180° to effect secure grip without overworking the sensitive fingertips. (The thumb has a proximal phalanx which can also rotate a full 180°. Note that the proximal phalanx of the thumb has an approximate mechanical range equivalent to that of the middle phalanx of each finger, and that the proximal phalanx of the thumb can function as the mechanical equivalent of the middle phalanx even though the thumb has two phalanges instead of three.) As the hand contracts, and as the middle phalanges orient to a position parallel with the metacarpals, the folded configuration of the palmar tissues compensates for the sharp angles of the joints and results in the characteristic palmar curve. The phenomenon of curvature may be most easily observed at the base of each finger of the palmer side: the fingers appear to bend there, even though the bones (the proximal phalanges) do not. The palmar curve permits "wrap-around grasp," the ability of the metacarpals and the phalanges to curve around, grip and sense any given surface.

Artificial padding, such as that of the two devices described above, disrupts wrap-around grasp by padding only a portion of the curve; in particular, the devices pad only a portion of the proximal phalanx. Because the proximal phalanx is an entirelyrigid bone and cannot bend to compensate, any partial padding along its palmar surface leaves a space between the object grasped and the uncovered portion of the phalanx, resulting in abnormal palmar sensations and physically insecure grip.

The two described devices also impede normal awareness of dorsal resistance, and do so in two ways. First, they pad the proximal palmar surface, resulting in an increase in the sensation of palmar compression without the normal proportional increase in dorsal resistance at the proximal interphalangeal joints. The imbalanced sensations thus disrupt and impair normal tactilegnosis. Second, the snug partial gloves restrain the skin which lies beneath them, thus requiring abnormal compensatory stretching in the skin at the distal edge of the glove. (Characterized differently, the gloves cause dorsal resistance themselves, and apply it in an abnormal location.) As a result, the tubular protective device described above produces maximum sensation of resistance at the metacarpophalangeal joints ("knuckles"), and the short-fingered glove causes maximum resistance along the proximal phalangeal shafts. Neither device, therefore, preserves the natural compression-balanced sensation of resistance on the proximal interphalangeal joints. Accordingly, neither device permits the normal sensation of dorsal resistance necessary for sensitive and accurate contraction of the hand.

One final difficulty persists throughout most or all of the partial-glove devices: a snug glove covering, exposing all or most of each finger, is difficult to remove. (U.S. Pat. No. 360,135 to Blomstrom sets forth a short-fingered glove with loose extension "tabs" on one, two or three of the digits, but these tabs cannot facilitate glove removal over the remaining two finters.) Such a glove, tight by design, additionally adherent as a result of the natural perspiration of the hand, and without fingertips to pinch and pull, usually must be removed by grasping the wrist portion and inverting the glove over the hand and fingers. The inversion-removal method significantly shortens the life of the glove by subjecting it to stretching both during removal and during the reverse-inversion necessary before the next wearing. (This stretching is often severe, due to the impatience of the inconvenienced wearer.)

OBJECTS OF THE INVENTION

Accordingly, it is an object of the present invention to provide a protective glove which is effective in absorbing trauma to the hand.

Another object of the invention is to provide a protective glove which maximizes the "fingertip feel" tactilegnotic ability of the hand.

A further object of the invention is to provide a protective glove which maximizes the "wrap-around grasp" tactilegnotic ability of the hand.

Still another object of the invention is to provide a protective glove which preserves normal awareness of balanced "dorsal resistance" tactilegnosis during the use of the hand.

A further object of the invention is to provide a glove suitable for baseball and softball which effectively protects the hand, yet maximizes its overall tactilegnotic abilities.

Still another object of the invention is to provide a protective glove which is easy to position and remove, and which has increased longevity due to such easy positioning and removal.

SUMMARY OF THE INVENTION

The foregoing and additional objects are attained by providing a glove of shock-absorbent material, for baseball or other activities, the digital sheaths of which expose the distal phalanx yet extend to cover the proximal interphalangeal joint (or its first-digit equivalent). The glove, therefore, pads the critical area of wrap-around grasp-the metacarpals and the entire shaft of the proximal phalanx-yet permits unimpeded "fingertip feel." Furthermore, the glove preserves the normal sensation of dorsal resistance by covering both the palmar curve and the dorsal surfaces of the proximal interphalangeal joints: the slight stiffness of the glove increases the sensation of palmar compression during hand contraction and, simultaneously, the snug digital sheaths apply commensurate pressure to the dorsal joint surfaces, thus maintaining the relative proportion of dorsal resistance to palmar compression. As a result, the device not only permits wrap-around grasp and allows fingertip feel but preserves the normal phenomenon of dorsal resistance sensation and maximuzes the overall tactilegnotic ability of the protected hand.

Each digital sheath terminates, in addition, in a loose extension, or "tab," which, together with a releasable fastener at the wrist, facilitates easy removal of the snug, partial-fingered glove. The illustrative embodiment of the invention includes light partial padding, and the alternate embodiment includes specialized padding arrangements which incorporate slow-recovery foam to maximize the ability of the glove to absorb shock or trauma inflicted upon the vulnerable areas of the hand.

DETAILED DESCRIPTION OF THE INVENTION-STRUCTURE

In the description which follows, the terminology of hand anatomy is self-evident. Because the hands are mirror images of each other, however, it is of little use to refer to the "right" or "left" side of the hand. Accordingly, the sides of the hand are known relative to the corresponding bones of the forearm: the "thumb" side of the hand is the "radial" side, located opposite to the "ulnar" side.

Figure 1:
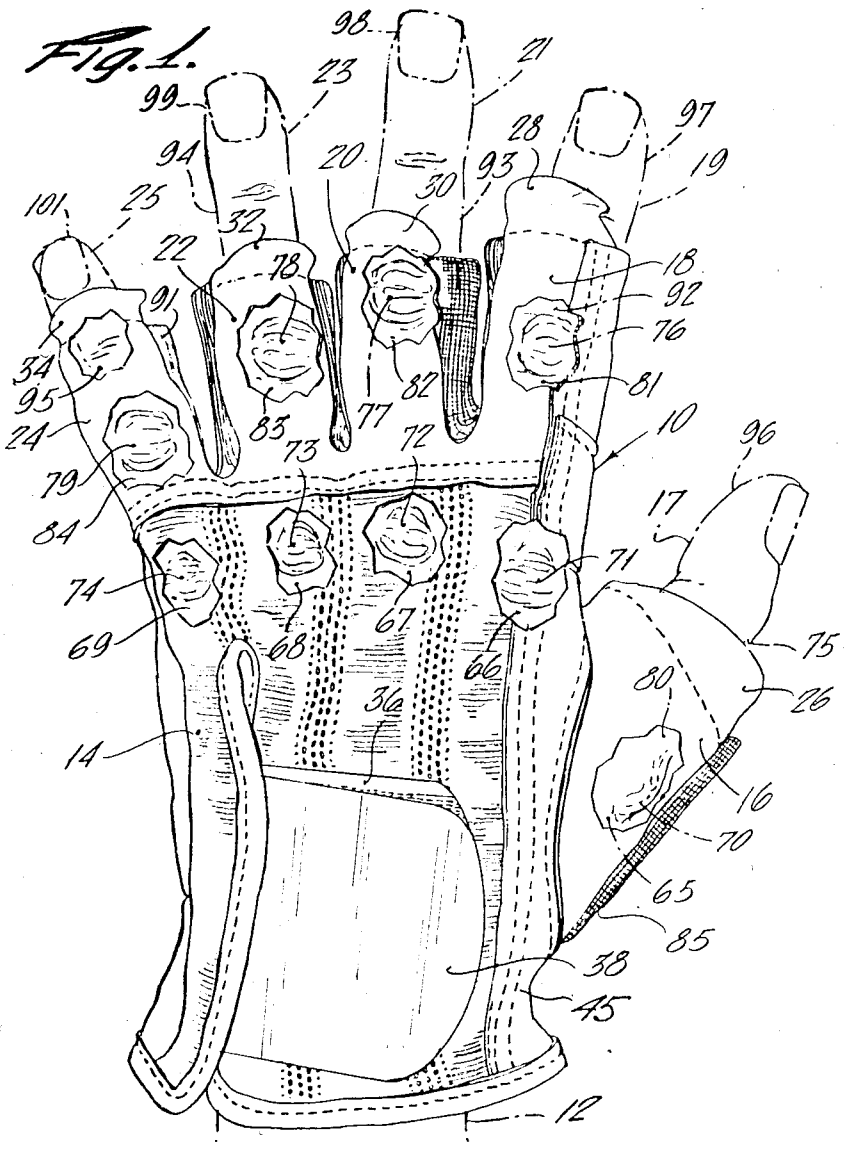
FIG. 1 is a perspective view of the dorsal surface of the illustrative embodiment of the invention.

Referring now to the drawings and initially to FIG. 1, which illustrates the dorsal surface of the illustrative embodiment of the invention, a protective glove 10 covers the hand 12 by sheathing the metacarpal area (including the first, second, third, fourth and fifth metacarpals 65, 66, 67, 68 and 69) and the first, second, third, fourth and fifth digits 17, 19, 21, 23 and 25 respectively.

The first digital sheath 16 covers the first digit 17 from the first metacarpophalangeal joint 70 to a predetermined point along the shaft of the proximal phalanx 80; the sheath 16, as a result, covers the first metacarpophalangeal joint 70 of the first digit 17 but exposes its distal phalanx 96. The second, third, fourth and fifth digital sheaths 18, 20, 22 and 24 individually cover each of the respective digits 19, 21, 23 and 25; these sheaths cover the second, third, fourth and fifth proximal phalanges 81, 82, 83 and 84 and the respective proximal interphalangeal joints 76, 77, 78 and 79. The sheaths terminate at predetermined points along the shafts of each middle phalanx 92, 93, 94 and 95, thus exposing each distal phalanx 97, 98, 99 and 101. Each of the digital sheaths 16, 18, 20, 22 and 24 is attached to the metacarpal sheath 14, resulting in a partial protective glove 10.

Each of the digital sheaths 16, 18, 20, 22 and 24 includes a "tab," or loose extension, 26, 28, 30, 32 and 34, respectively. Each tab 28, 30, 32 and 34 extends distally from the dorsal portion of the digital sheath; the tab 26, to prevent interference with the thumb, has an ulnar orientation on the first digit 16. The tabs require no peripheral stitching. The dorsal metcarpal sheath 45 is bifurcated and the two sections are releasably securable via fastener hook patch 36 and the cooperating fastener loop pad 38.

Figure 2:
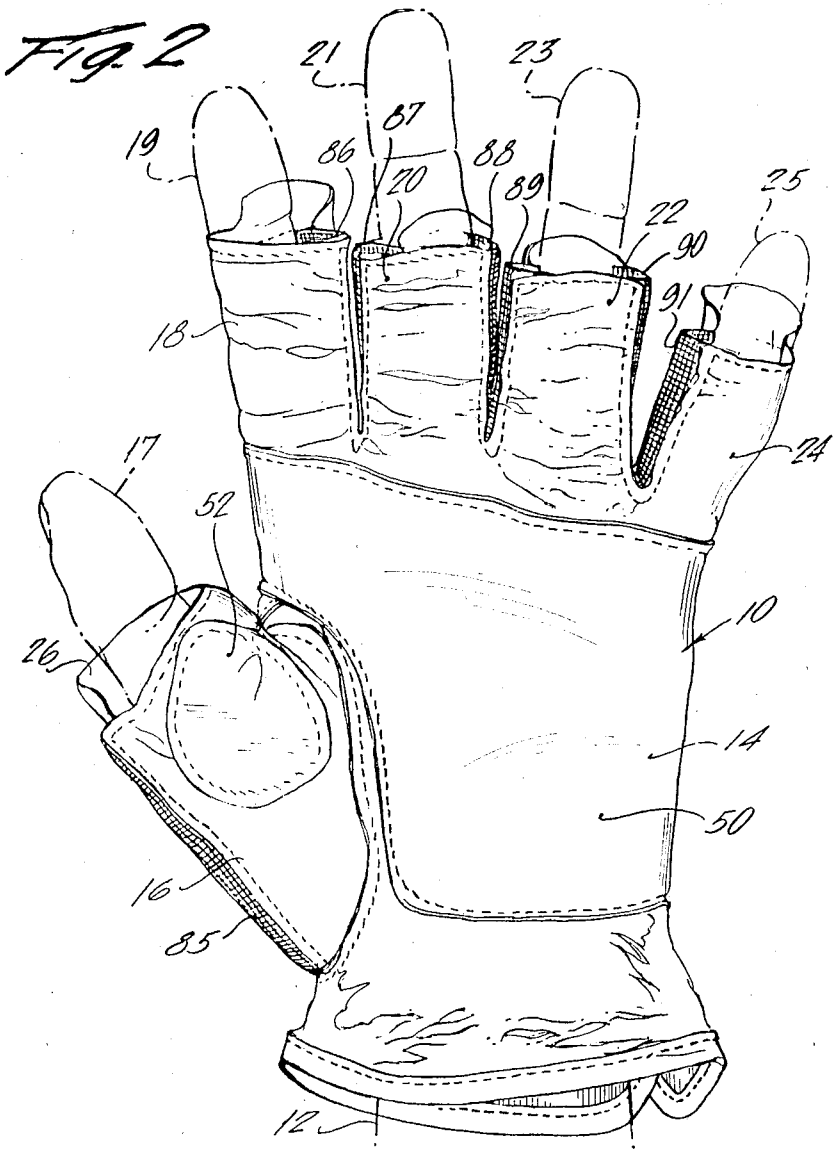
FIG. 2 is a perspective view of the palmar surface of the illustrative embodiment of the invention.

FIG. 2 illustrates the palmar surface of the illustrative embodiment of the invention, and depicts the palmar surfaces of the glove 10, the hand 12, the metacarpal sheath 14, and the digital sheaths 16, 18, 20, 22 and 24. FIG. 2 also illustrates the palmar metacarpal pad 50 and the palmar thumb pad 52. The palmar metacarpal pad 50 covers the entire palmar area between the wrist and the second, third, fourth and fifth metacarpophalangeal joints 71, 72, 73 and 74, excluding the surface of the thenar eminence, the mound at the base of the thumb. The palmar thumb pad 52 is generally oval in shape and covers the first digital metacarpophalangeal joint 70. As an element of the first embodiment of the invention, each pad 50 and 52 comprises an additional thickness in the substance of the glove 10, such thickness ordinarily resulting in a double glove thickness at the locus of each pad.

Figure 3:
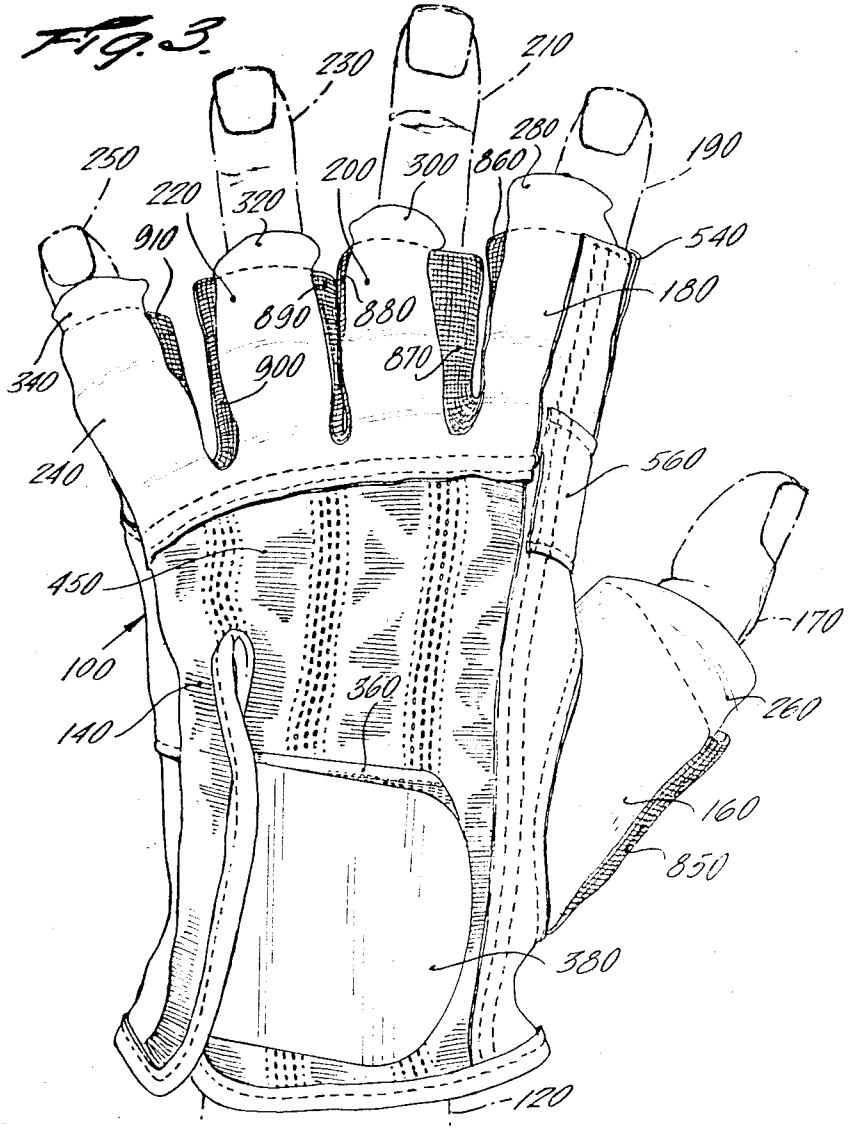
FIG. 3 is a perspective view of the dorsal surface of the alternate embodiment of the invention.

Referring now to FIG. 3, which illustrates the dorsal surface of the alternate embodiment of the invention, a protective glove 100 covers the hand 120 as does the first embodiment of the invention. The first digital sheath 160 covers the first digit 170 from the metacarpophalangeal joint to a predetermined point along the shaft of the proximal phalanx; the sheath 160, as a result, covers the metacarpophalangeal joint of the first digit 170 but exposes its distal phalanx. (The proportion of the digital sheaths to the hand is identical to that of the illustrative embodiment of the invention.) The second, third, fourth and fifth digital sheaths 180, 200, 220 and 240 individually cover each of the respective digits 190, 210, 230 and 250; these sheaths cover the proximal interphalangeal joints and terminate at predetermined points along the shafts of each middle phalanx, thus exposing each distal phalanx. Each of the digital sheaths 160, 180, 200, 220 and 240 is attached to the metacarpal sheath 140, and the combination results in the glove 100, which covers the entire hand except for the distal phalanges.

Each of the digital sheaths 160, 180, 200, 220 and 240 includes a tab 260, 280, 300, 320 and 340, respectively. As in the illustrative embodiment, the dorsal metacarpal sheath 450 is bifurcated and the two sections are releasably securable via fastener hook patch 360 and the cooperating fastener loop pad 380. A dorsal metacarpophalangeal pad 560 covers the dorsal surface of the metacarpophalangeal joint of the second digit 190.

Figure 4:
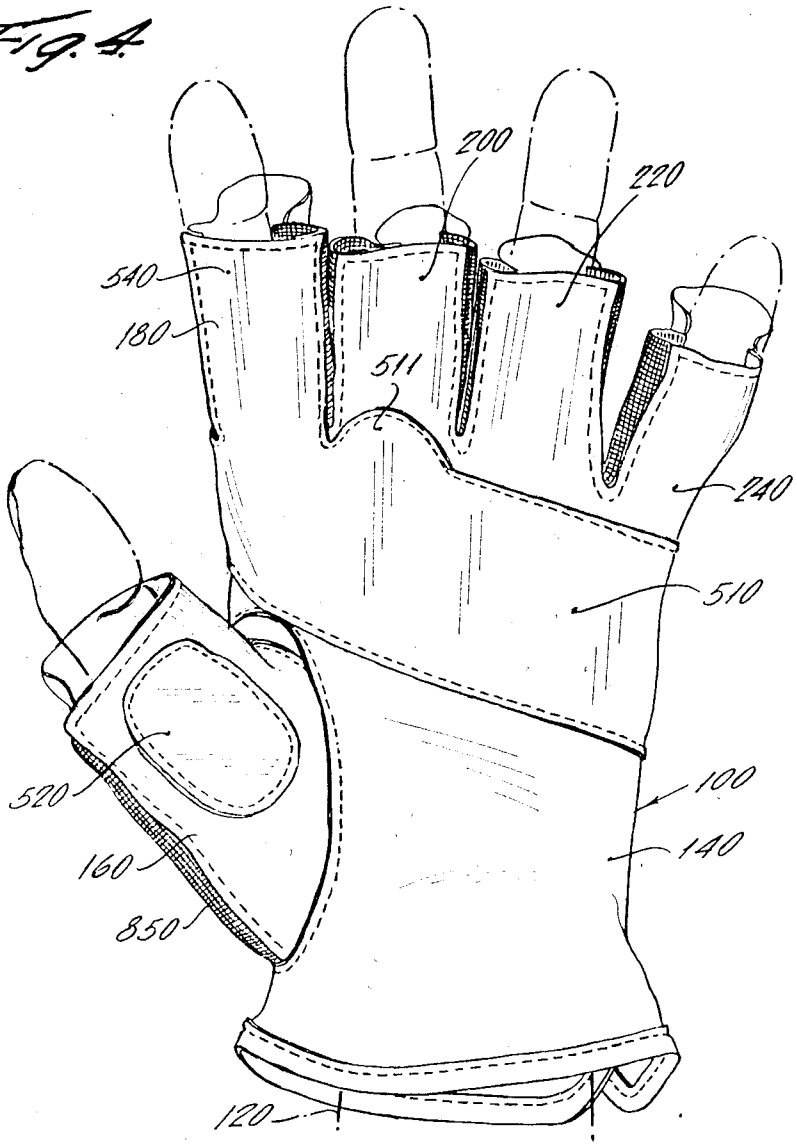
FIG. 4 is a perspective view of the palmar surface of the alternate embodiment of the invention.

FIG. 4 illustrates the palmar surface of the alternate embodiment of the invention, and depicts the palmar surfaces of the glove 100, the hand 120, the metacarpal sheath 140, and the digital sheaths 160, 180, 200, 220 and 240. FIG. 4 also illustrates the palmar metacarpophalangeal pad 510, the palmar thumb pad 520 and the second digital palmar pad 540. The palmar metacarpophalangeal pad 510 extends from the digital palmar crease (the "middle" crease) to cover the metacarpophalangeal joints, thus protecting the latter without excess palmar padding. The palmar thumb pad 520 is generally oval and protects the first digital metacarpophalangeal joint, while the second digital palmar pad 540 extends the entire length and width of the palmar surface of the second digital sheath 180 to protect the second digital 190. Note that the combined pads 510 and 540 result in a generally L-shaped pad. Furthermore, a "half-circle" third digital palmar pad 511 covers the base of the proximal phalanx of the third digit. As an element of the alternate embodiment of the invention, each pad 510, 511, 520 and 540 includes a layer of slow-recovery foam; the foam may be stitched or bonded to the inside or the outside of the glove surface, or may be incorporated between layers of the glove material.

Referring again to FIG. 3, the dorsal metacarpophalangeal pad 560 may be seen as a wrap-around extension of the palmar metacarpophalangeal pad 510. This pad 560 is a generally square-shaped pad which covers at least a portion of the dorsal surface of the second metacarpophalangeal joint.

The illustrative and alternate embodiments shown in FIGS. 1–4 are designed for the left hand. The left and right hands are identical in arrangement and function, however, in spite of their respective "mirror image" structures. In like fashion, the illustrative and alternate embodiments of the invention may be provided for the right hand, without any change in the design of the component parts except to reverse their "handedness." Because no part is labelled as to "right" or "left" orientation, the names and arrangements of the parts of both the left and right devices are the same.

Figure 5:
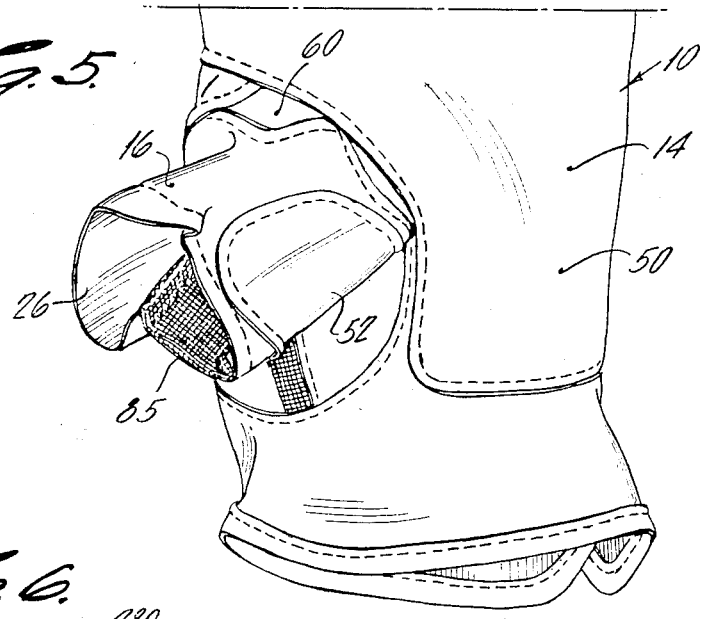
FIG. 5 is a partial palmar view of the palmar gusset of the illustrative embodiment of the invention.

FIG. 5 is a partial perspective view of the illustrative embodiment of the invention which illustrates the palmar gusset 60 between the first digital sheath 16 and the metacarpal sheath 14. This gusset 60 reinforces the juncture of the sheaths 14 and 16 and prevents unnecessary stress on the stitches therebetween. The alternate embodiment of the invention has a gusset (not shown) which is identical to that shown in FIG. 5.

DETAILED DESCRIPTION OF THE INVENTION-OPERATION

Referring again to FIG. 1, the illustrative embodiment of the invention is prepared for positioning by separating the fastener loop pad 38 from the fastener hook patch 36, thus expanding the metacarpal sheath 14 for easy admission of the hand 12. After the hand is in place, the patch 36 and the pad 38 are fastened together by gentle manual pressure to secure the metacarpal sheath 14 snugly in place.

As described above, the first digital sheath 16 covers the first digit 17 from the metacarpophalangeal joint 70 to a predetermined point along the first proximal phalanx 80. The second, third, fourth and fifth digital sheaths 18, 20, 22 and 24 cover the digits 19, 21, 23 and 25 from the metacarapophalangeal joints 71, 72, 73 and 74 to the middle phalanges 92, 93, 94 and 95 and, by covering the proximal phalanges, this structure functions to maximize wrap-around grasp tactilegnosis in the manner described below.

The hand includes four rows of bones from the wrist to the fingertips: the metacarpals and the proximal, middle and distal phalanges. (The thumb, of course, has only two phlanges.) The outermost two rows (the distal and middle phlanges) consist of bones which are relatively much smaller than the rows innermost (the proximal phalanges and the metacarpals); indeed, each distal phalanx is half as long as its corresponding proximal phalanx, and each middle phalanx has half the length of its corresponding metacarpal. The shorter distal bones result in a high degree of fingertip articulation, but the rigid, relatively lengthy metacarpals and proximal phalanges would, were it not for the compensating palmar tissues, limit the ability of the hand to "curve around" (because bones will not curve) a baseball, bat or other object or surface. Because the palmar tissues over the metacarpals and proximal phalanges are specialized, however, the palmar tissues assume a folded and curved configuration which permits secure grip in spite of the unbending length of the metacarpals and the proximal phalanges. Although all of the palmar tissues are important, therefore, the palmar tissues associated with the metacarpals and proximal phalanges are critical in establishing the characteristic palmar curve during synchronous flexion of the bones of the hand.

The illustrative embodiment of the present invention covers the palmar surface from the wrist to the proximal interphalangeal joints and pads the entire metacarpal and proximal phalangeal area. By padding the area as evenly as possible with a thin covering between 1 and 2 mms., the glove preserves the characteristic curve of the hand as much as possible and also preserves its commensurate ability of wrap-around grasp. Furthermore, by padding the entire metacarpal and proximal phalangeal area, even pressure is maintained on all parts of the surface to maximize the normal sensations associated with wrap-around grasp, regardless of the orientation or curvature of the hand.

The illustrative embodiment of the invention functions, in addition, to permit normal "fingertip-feel" tactilegnosis; because each distal phalanx is exposed, the wearer of the glove retains normal fingertip feel at all times.

The illustrative embodiment also functions to maximize the normal sensation of "dorsal resistance" necessary for maximum tactilegnosis. The glove preserves the normal sensation of dorsal resistance by covering both the palmar curve and the dorsal surfaces of the proximal interphalangeal joints: the slight stiffness of the glove increases the sensation of palmar compression during hand contraction and, simultaneously, the snug digital sheaths apply commensurate pressure to the dorsal joint surfaces, thus maintaining the relative proportion of dorsal resistance to palmar compression. Furthermore, the glove functions equally well during extension of the flexed joints; as the hand flattens, the sensations of palmar compression and dorsal resistance decrease proportionally as a result of the relative decrease in overall stress on the glove.

Referring now to FIG. 2, the palmar metacarpal pad 50 functions to protect the bones and tissues which it covers. The leather sheath both absorbs and disperses shock, thus protecting against any trauma inflicted upon the hand in the area of the pad. The pad also functions to protect the glove; because the palmar metacarpal pad 50 constitutes a double thickness of leather in an area of high stress, the pad can potentially double the life of the glove.

The palmar thumb pad 52 protects the underlying digit, and protects the first metacarpophalangeal joint 70 in particular. This joint (as do all the metacarpophalangeal joints) protrudes slightly, resulting in its particular vulnerability to injury. The pad 52, however, absorbs and disperses shock to minimize the risk of injury. In addition, the pad protects the proximal portion of the proximal phalanx, which is also vulnerable to injury when the first digit is hyperextended.

The glove 10 and the pads 50 and 52 protect against trauma to the hand in two ways. First, they cushion the hand against stress inflicted by the action of an object or surface on the hand, i.e., the sting of catching a ball. Second, they protect the hand against the stress of gripping a solid and unyielding surface, i.e., the trauma of gripping a baseball bat or an exercise weight. In either case, the glove and the pads protect against tissue bruising and bone contusions by absorbing and dispersing shock of any kind.

The illustrative embodiment of the invention is easy to remove. The fastener loop pad 38 is manually separated from the fastener hook patch 36 to result in a loosened metacarpal sheath. The wearer then sequentially grasps and gently pulls each loose extension tab 26, 28, 30, 32 and 34; the glove 10, with a loosened metacarpal sheath 14, is thus readily removed from the hand 12 without subjecting the stitching or materials to strain resulting from unnecessary inversion or forceful tugging of the glove.

The protective glove 10 permits, therefore, maximized overall tactilegnosis and ease of positioning and removal while offering effective hand protection. The glove is accordingly well-suited for use in any activity where both dexterity and hand protection are required, such as labor with percussive hand tools or sports such as baseball, golf, tennis, field hockey, polo and the paddle sports.

Referring now to FIG. 3, the alternate embodiment of the invention is prepared for positioning by separating the fastener loop pad 380 from the fastener hook patch 360, thus expanding the metacarpal sheath for easy admission of the hand 120. After the hand is in place, the patch 360 and the pad 380 join to secure the metacarpal sheath.

Because the alternate embodiment differs from the preferred embodiment only in the arrangement and configuration of its padding, the alternate embodiment maximizes overall tactilegnosis in the same manner as the illustrative embodiment. The digital sheaths 160, 180, 200, 220, and 240 thus permit the fingertip-feel, the wrap-around grasp and the normal sensation of dorsal resistance necessary to maximize tactilegnotic ability.

Figure 6:
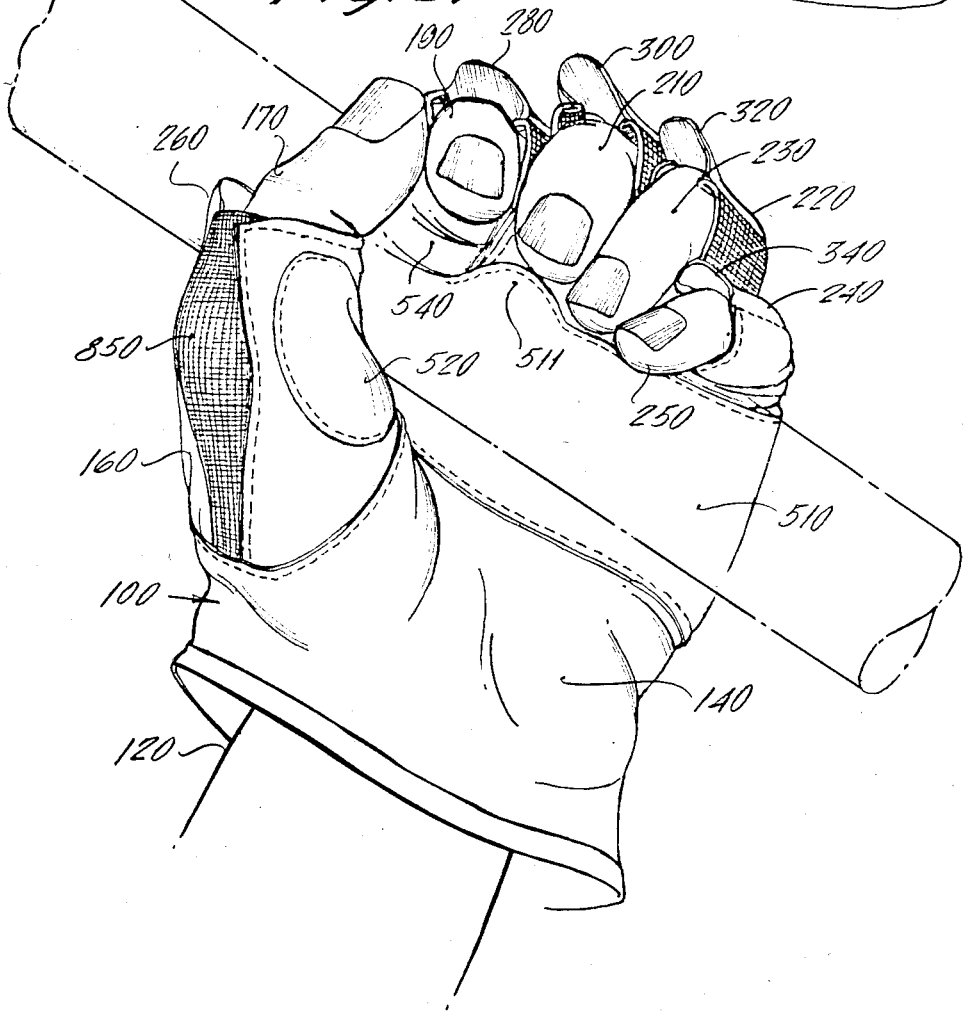
FIG. 6 is a cross-sectional view of the illustrative embodiment of the invention as worn by a contracted.

Referring now to FIG. 6, the interrelationship between the palmar metacarpophalangeal pad 510, the third digital palamar pad 511, the palamar thumb pad 520 and the second digital palamar pad 540 may be observed. As the hand flexes, the first digit 160 and its pad 520 rotate to oppose the remaining digits. As the hand flexes, the palmar metacarpophalangeal pad 510 decreases in width, due to the marshmallow-like characteristics of the slow recovery polyesper foam incorporated therein. The third digital palmar pad curves over and protects the third metacarpophalangeal joint.

The second digital palmar pad curves with and conforms to its corresponding digit.

The pads 510, 511, 520 and 540, taken in combination, provide a glove well-suited for holding a baseball bat; as illustrated in FIG. 6, the bat i easily held and supported in a protected, balanced hold. The pads are particularly suited to protecting each hand as the bat contacts the ball; the palmar thumb pad 520 absorbs the shock of impact and the opposing pads 510, 511 and 540 absorb the recoil, ensuring protection of all of the metacarpophalangeal joints and the second digital area (the "pressure points" of batting).

The arrangement of pads also protects the hand from the sting of catching a ball. The metacarpophalangeal joints are protected by pads 510, 511 and 520. The second digital palmar pad 540 protects the second digit for the entire length of the second digital sheath. The third digital palmar pad 511 extends to cover the proximal portion of the proximal phalanx to protect it from concussion to that bone, particularly when the finger is hyperextended and the proximal shaft is abnormally exposed. Indeed, although the fielder is seldom (if ever-)aware of it, the ball is almost always caught at the base of the thirdd digit, the effective center point of the poised catching hand. The third digital palmar pad 551, therefore, specifically protects the vulnerable base of the third digit from injury during ordinary fielding maneuvers adding to the overall protection of the pad arrangement as a whole. (Note that the proximal interphalangeal joints are protected, as the ball is caught, by the digital sheaths themselves. Note also, as illustrated in FIG. 6, that the pads 510, 511, 520 and 540 minimize disturbance of the natural curvature of the hand.)

The dorsal metacarpophalangeal pad 5560 functions in two ways. First, it protects and covers the dorsal and radial surfaces of the second metacarpophalangeal joint. Second, it provides a wrap-around extension of the palmar metacarpophalangeal pad 510; as a result, the pad 560 increases the surface area of the pad 510 and increases its ability to absorb shock. Because of the relatively small size of the pad 560, however, it does not significantly alter the normal sensation of dorsal resistance preserved by the digital sheaths 160, 180, 200, 220, and 240.

The alternate embodiment of the invention is removed in the same manner as is the illustrative embodiment. The fastener loop pad 380 is manually separated from the fastener hook patch 360 to result in a loosened metacarpal sheath. The wearer then sequentially grasps and gently pulls each loose extension tab 260, 280, 300, 320 and 340; the glove 100, with a loosened metacarpal sheath 140, is thus readily removed from the hand 120 without subjecting the stitching or materialsto strain resulting from unnecessary inversion or forcefur tugging off the glove.

The protective glove 100 permits, therefore, maximized overall tactilegnosis and ease of positioning and removal. The glove is accordingly well-suited for use in any activity where both dexterity and hand protection are required and, as a sports glove, the invention is particularly beneficial as a batting glove and as a protective insert to a fielding or baseman's glove or a catcher's mitt.

DETAILED DESCRIPTION OF THE INVENTION-MATERIALS

The exemplary model of the illustrative embodiment of the invention included a glove, U.S. size 6–7, made of 1 mm. thick cabretta leather (a finely-perforated kidskin known in the art). The metacarpal sheath portion of the glove measured 20 cm. in circumference and 11 cm. in length; the dorsal portion was constructed of a ribbed knit material (availabble under the tradename STATITE) which, although sturdy, is lightweight and porous to allow evaporation of perspiration. The dorsal metacarpal sheath was bifurcated to permit easy positioning and removal; the bifurcating slit extended distally from the wrist and measured 8 cm. All proximal edges of the metacarpal sheath were bound in a folded vinyl binding 1 cm. wide.

The two sections of the dorsal metacarpal sheath, resulting from the bifurcating slit, were releasably fastened together by a patch and cooperating tab of VELCRO, a hook-and-loop fastening means. The hook patch and loop pad each measured 4 cm. ×5 cm., and the loop pad was protectively covered by a decorable vinyl surface.

The digital sheaths, connected to the metacarpal sheath, were each constructed of cabretta leather and panels of LYCRA SPANDEX, a cool and permeable stretch knit textile. The first digital sheath included a tapered cylinder measuring 2 cm. in length and 8 cm. in circumference at its distal edge; the cylinder was made of cabretta leather and a 1 cm. wide strip 85 of LYCRA SPANDEX at the radial edge of the thumb. The second digital sheath was also constructed of a cylinder of cabretta leather, measuring 4 cm. in length and 6 cm. in circumference at its distal edge, including a 1 cm.×4 cm. strip 86 of LYCRA SPANDEX on the ulnar side of the digit. The third and fourth digital sheaths each measured 4.5 cm. in length and 6 cm. in circumference, and included the 1 cm.×4 cm. LYCRA SPANDEX panels 87, 88, 89 and 90 on both the radial and ulnar sides of the cylinder. The fifth digital sheath measured 3 cm. in length and 5 cm. in circumference and included a 1 cm.×3 cm. LYCRA SPANDEX panel 91 on the radial side of the fifth digit.

The loose extension "tabs" on each of the digital sheaths constituted 1 cm. extensions of the dorsal portion of the digital sheath leather.

The palmar metacarpal pad and the palmar thumb pad are constructed of sections of cabretta leather; these sections, like the sheaths of the glove, are 1 mm. thick, resulting in a total leather thickness of 2 mm. in the area of each pad. The palmar gusset is also constructed of a single 1 mm. thickness of cabretta leather; this gusset was fashioned by stitching a diamond-shaped leather section 2 cm.×5 cm. between the proximal edge of the first digital sheath and the radial portion of the metacarpal sheath. The gusset is stitched with stranded polyester thread, as are the pads, the sheaths, the vinyl binding, the fastener pad and the fastener patch.

The exemplary model of the alternate embodiment of the invention included a glove (U.S. size 10–11) which is also made of cabretta leather. The metacarpal sheath measured 12 cm. in length and 22 cm. in circumference. The first, second, third, fourth and fifth digital sheaths measured 2.5×8 cm., 5×7 cm., 4.5×7 cm., 4.5×6 cm., and 4.5 cm. in length and circumference, respectively. The palmar metacarpophalangeal pad measured 11×4 cm., the second digital palmar pad measured 3×5 cm., and the dorsal metacarpophalangeal pad measured 3×3 cm. As did the model of the first embodiment, the model of the alternate embodiment included a dorsal metacarpal sheath constructed of "STATITE," bifurcated by an 8 cm. slit, diamond-shaped 2×5 cm. palmar gusset, digital sheath panels 850, 860, 870, 880, 890, 900 and 910 of LYCRA SPANDEX 1 cm. wide, vinyl binding, nylon stitching, 1 cm. loose extension "tabs" and a vinyl-covered VELCRO pad and patch fastener.

The alternate embodiment model, however, provided padding more specialized than that of the illustrative embodiment. The interconnected palmar metacarpophalangeal pad, dorsal metacarpophalangeal pad and second digital palmar pad each included a 3 mm. thickness of slow-recovery polyesper foam covered by a 1 mm. thickness of cabretta leather; the palmar thumb pad likewise included a 3 mm. thickness of foam.

The slow-recovery polyesper foam is also known as "T-foam", temper foam, contour foam and temper stick foam. The foam absorbs impact without transmitting it to an adjacent surface, by deforming on impact and slowly recovering its original shape. Because it does not immediately spring back, the foam provides a shock absorbing property rather than a springy resistant property. In addition, body heat conforms such a foam evenly to the entire physiological contact surface, resulting in a comfortable, even pad. Slow recovery polyesper foam is manufactured by a proprietary process and formuation of Temper Foam, Inc., 4954 Provident Drive, Cincinnati, OH 43246, and is commercially distributed by Kess-Goebel, 4954 Provident Drive, Cincinnati, OH 43246 and by Creative Foam Corporation, 511 Beach Street, Fenton, MI.

Various changes may be made in the shape, size and arrangement of parts without departing from the spirit or scope of the invention. For example, extra thicknesses of padding may be provided in the illustrative embodiment of the invention and the slow-recovery foam may be eliminated from the alternate embodiment, thus increasing or decreasing the thickness of the pads as described. In additional, other materials are suited for use in construction of the invention, such as woven and knit textiles and leathers such as pigskin and cowhide. Split cowhide, in particular, is a good shething substance for use under wet conditions, because the suede-like surface does not become slippery even when submerged. These materials, as well as synthetics and cellular sponge materials, may also be incorporated in the pads and the gusset as alternative to leather and polyesper foam. The LYCRA SPANDEX, STA-TITE and vinyl binding may be replaced with other glove materials or may be eliminated altogether in preference to a glove c onstructed of a single sheathing substance. The pads may likewise be eliminated entirely in preference to a protective glove of a single thickness. Any type or weight of thread may be used. A clasp, buckle, snap, button or other type of interlocking fastener may be used instead of VELCRO to secure and release the wrist portion of the glove, and such a fastening arrangement may be positioned at any palmar or dorsal wrist location.

These and other applications of the present invention will be readily apparent to those skilled in the art in light of the above teachings. It is, therefore, to be understood that the invention may be practiced otherwise than as specifically described and claimed herein.

What is claimed is:

1. A glove for protecting the hand, comprising a back portion and a palm portion, said palm portion including a metacarpal sheath covering at least the palm of the hand, a plurality of digital sheaths attached to the metacarpal sheath including a first digital sheath covering the thumb from the metacarpophalangeal joint to a predetermined point on the proximal phalanx of the first digit; and second digital sheaths covering the four fingers from the metacarpophalangeal joints to a predetermined point on each of the four respective middle phalanges, and means for absorbing impact shocks including a single unitary pad mounted on the exterior of said sheaths comprising a first palmar metacarpophalangeal pad portion extending from the digital palmar crease to the metacarpophalangeal joints and a second digital palmar pad portion covering the palmar surface of the proximal phalanx of the second digit of the hand and a third digital palmar pad portion covering a portion of the digital sheath of the third digit, and padding means interposed between said pad and said sheaths comprising a heat-sensitive, slow-recovery, shock-absorbing polyesper foam material which deforms on impact and slowly recovers its original shape and absorbs impact without transmission to an adjacent surface.

2. A glove as claimed in claim 1 wherein said second digital palmar pad covers the entire length of the second digital sheath.

3. A glove as claimed in claim 2 including a palmar thumb pad.

* * * * *